United States Patent [19]

Woodfill

[11] 3,994,254

[45] Nov. 30, 1976

[54] TRANSMISSION FOR A MARINE JET DRIVE

[75] Inventor: William L. Woodfill, Fond du Lac, Wis.

[73] Assignee: Brunswick Corporation, Skokie, Ill.

[22] Filed: July 10, 1974

[21] Appl. No.: 487,285

[52] U.S. Cl. ..... 115/14; 74/373

[51] Int. Cl.[2] ..... B63H 11/02

[58] Field of Search ..... 115/11, 12 R, 14, 15, 115/16, 34 R, 34 A, 35; 74/331, 335, 336, 337, 336.5, 368, 781 R

[56] References Cited

UNITED STATES PATENTS

| | | | |
|---|---|---|---|
| 2,532,945 | 12/1950 | Robinson | 74/335 |
| 2,590,231 | 3/1952 | Chilton | 74/336 |
| 3,019,666 | 2/1962 | Brennan et al. | 74/336 |
| 3,164,036 | 1/1965 | Lamburn et al. | 74/781 R |
| 3,532,068 | 10/1968 | Lamburn | 115/34 R |

*Primary Examiner*—Trygve M. Blix
*Assistant Examiner*—Jesus D. Sotelo
*Attorney, Agent, or Firm*—Hopgood, Calimafde, Kalil, Blaustein & Lieberman

[57] ABSTRACT

The invention contemplates a multiple-speed transmission for coupling an engine to the impeller of a marine jet drive, such that an overdrive connection powers the jet drive under operating conditions up to a predetermined upper limit of cruising speeds and such that a reduced drive, for example a direct-drive connection, is automatically established for jet-drive speeds in excess of the cruising conditions. A simple illustrative transmission is described in detail, involving use of transmission lubricant as the actuating medium employed for hydraulic actuation of the engaged condition of the overdrive, all without impairing full circulation of the lubricant to and throughout the transmission, regardless of the engaged or disengaged condition of the overdrive.

21 Claims, 9 Drawing Figures

TRANSMISSION FOR A MARINE JET DRIVE

This invention relates to marine-jet drives and in particular to an automatic transmission for better match of engine output to jet-load conditions, over the cruising-speed range and for speeds above cruising range.

Performance characteristics of commercially available marine jet-pump propulsion units are well known, as are similar characteristics of propeller-driven craft. In general, boat for boat and engine for engine, propeller-driven craft are capable of about ten percent greater speed at wide open throttle, at least for the case of jet-pump and inboard/outboard driven boats of the size category represented by 18 to 22-ft. length overall. Taken alone, this speed difference is not too significant, if one considers the safety, absence of under-boat projections, and lower yearly maintenance of the jet drive. However, if the entire speed range is considered, the jet is seen to be at a significant disadvantage at slow-to-midrange speeds, i.e., for cruising performance. For example, at a 25-mph cruising speed for a given boat, the same engine will probably need to run at 1000 rpm more for marine-jet propulsion (J.P.) than for inboard/outboard (I.O.) propulsion, e.g., 3000 rpm vs. 2000 rpm. Greater engine noise, and adverse fuel and maintenance cost are the evident disadvantages.

It is, accordingly, an object of the invention to provide an improved transmission for a marine-jet drive, whereby cruising performance may be substantially improved.

Another object is to provide an automatic transmission of the character indicated for producing cruising-speed thrust in a jet drive, at engine speeds which are comparable for a propeller-driven craft at corresponding boat speeds.

A further object is to provide an automatic transmission which has the property of adjusting engine torque/H.P. to the torque/power requirements of the jet impeller, over a wide range of boat speeds.

It is a general object to achieve the foregoing objects with basically simple, reliable and economical structure, achieving significant improvement in marine jet drive performances from various standpoints, including noise reduction, fuel economy, and slow-speed maneuvering, as for docking.

Other objects and various further features of novelty and invention will be pointed out or will occur to those skilled in the art from a reading of the following specification, in conjunction with the accompanying drawings. In said drawings, which show, for illustrative purposes only, preferred forms of the invention:

FIG. 6 is a diagram schematically indicating elements of a modification of FIG. 1;

Figure 1:
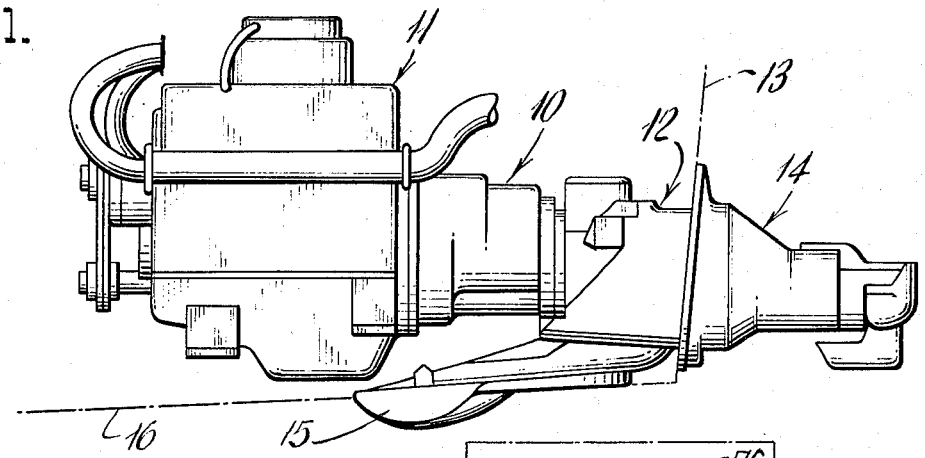
FIG. 1 is a simplified view in side elevation, showing an engine and marine jet drive coupled by a transmission of the invention.

Referring to FIG. 1, the invention is shown in application to an automatic transmission 10 which couples crankshaft output of an engine 11 to the impeller of a marine jet drive 12. The installation is in a small boat, for example, a 21-ft. boat having a transom 13 to which the casing for the stern discharge housing 14 of the drive 12 is mounted. As is conventional, the inlet 15 to the jet drive is substantialy flush with the boat bottom 16.

Figure 2:
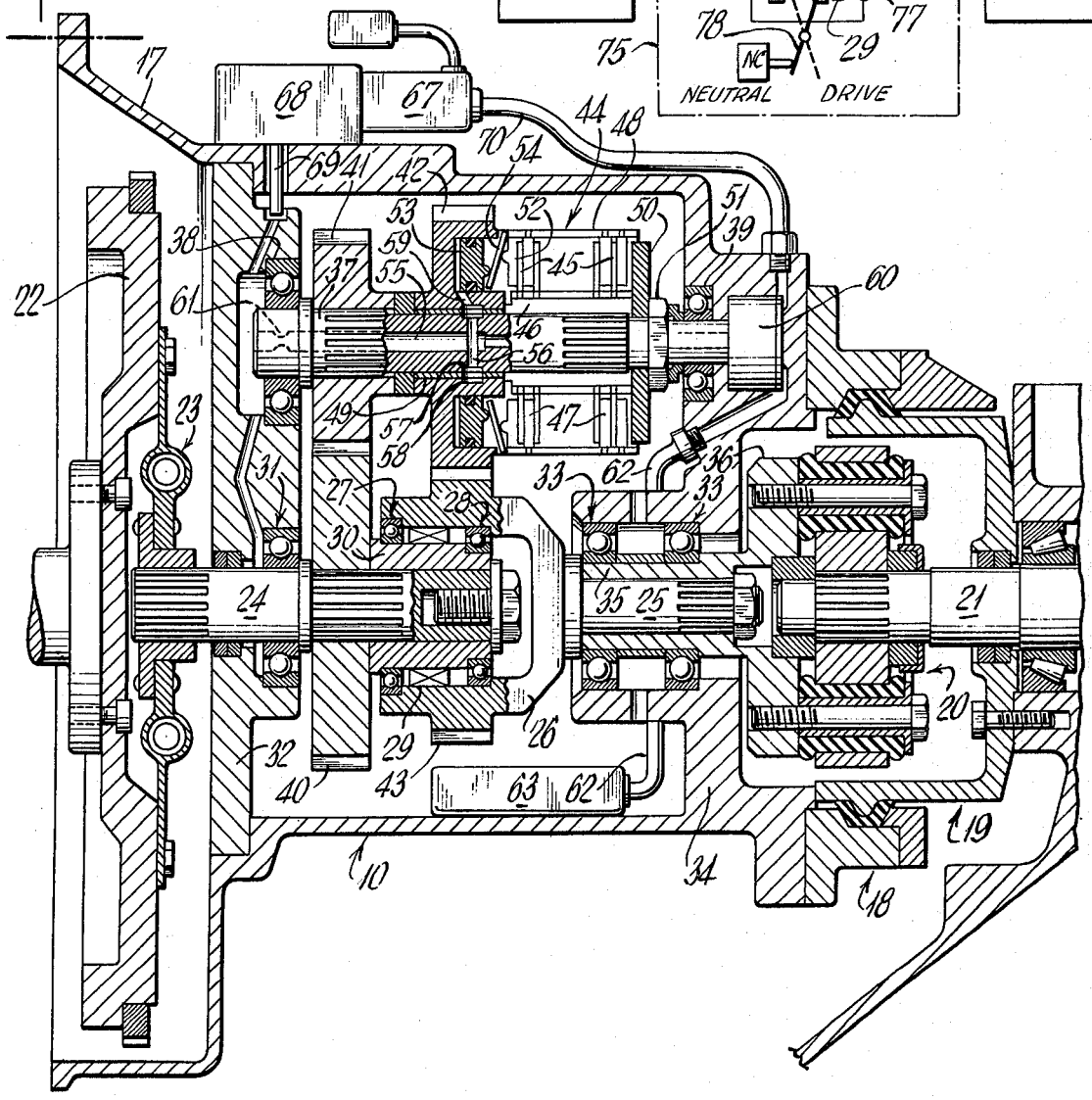
FIG. 2 is an enlarged longitudinal sectional view through key parts of the transmission in FIG. 1.

In FIG. 2, the housing of transmission 10 is shown connected at one end to the flywheel housing 17 of engine 11 and, at the other end, to the flanged annular mount 18 for the housing 19 of a coupling 20 to the impeller-drive shaft 21 of the jet drive 12. The engine flywheel 22 may be flexibly coupled by means 23 to the input shaft 24 of the transmission. The output shaft 25 of the transmission is on the same axis as shaft 24 and is formed with or otherwise carries a cupped member 26 having axial overlap with the adjacent end of the shaft 24; spaced radial bearings 27–28 assure concentric and aligned integrity of the region of such overlap, and one-way-engaging clutch means 29 coacts between the bore of member 26 and a bushing 30 having splined connection to shaft 24. Radial support of the input shaft 24 is via a bearing 31 in a forward wall of frame member 32, as well as by bearings 27–28; for the output shaft 25, such support is via bearings 33 in the rear wall or frame 34 of transmission 10. As shown, the sleeve-like hub 35 of the flanged driver element 36 of coupling 20 has splined fit to shaft 25 and is the seat for bearings 33.

In accordance with the invention, selectively disengageable overdrive means couples the shafts 24–25, in bridging (overriding) relation to the one-way clutch 29. As shown, a single jackshaft 37 is supported for rotation in end bearings 38–39 in the respective frames 32–34. First meshing gears 40–41 are splined to input shaft 24 and to jackshaft 37, respectively; and second meshing gears 42–43 are carried by jackshaft 37 and are formed in or carried by member 26, respectively. The overall speed-up of shaft 25 with respect to shaft 24, i.e., when driven via the overdrive gear train 40-41-42-43, may illustratively be expressed by a suitable overdrive ratio, e.g., 1:1.3. A single-acting hydraulically actuated disc clutch 44 is the means of selective connection/disconnection as between gears 41–42 on the jackshaft 37. Clutch 44 may comprise a first plurality of disc elements 45 axially movable along and angularly located by outer spline formations on a drive bushing or sleeve 46, keyed to jackshaft 37; and a second plurality of disc elements 47 is interlaced with elements 45, being also axially movable along and angularly located by spline or slot formations in an axially extensive sleeve or finger region 48 of the gear 42, while the latter is otherwise free to rotate via sleeve-bearing support at 49 on the jackshaft 37. An axially fixed end-plate abutment 50 is clamped by means 51 to the jackshaft, and an axially floating thrust plate 52 (keyed to 48) receives hydraulic actuating (left-to-right) thrust from an annular piston 53, via a Belleville spring washer 54 which is also keyed to 48, at the left-end limit of the same.

Piston 53 is shown at its left, or retracted, position in an annular hydraulic cylinder within the body of gear 42. Actuating hydraulic pressure is delivered to the head end of piston 53 via a central passage or line 55 in shaft 37, a radial passage or passages 56 to a manifolding circumferential groove 57 in shaft 37, in register with one or more apertures in sleeve bushing 49, and thence, via a manifolding groove 58 and radial passages 59. Whenever clutch 44 is to be engaged, oil pressure is delivered to line 55 by a pump 60 driven by shaft 37, and a restrictive or metering orifice plug 61 at the left end of line 55 assures delivery of the actuating pressure. Pump 60 is also relied upon for internal lubrication of the transmission, having a supply-line connection 62 to a sump filter 63 at the bottom of the pan which forms part of the transmission-housing enclosure.

Figure 3:
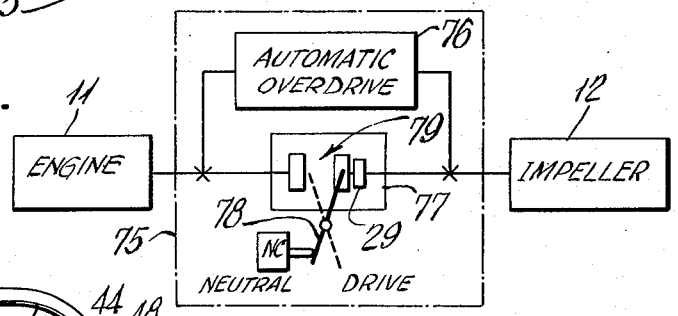
FIG. 3 is a diagram schematically indicating electrical and hydraulic control elements for the transmission of FIGS. 1 and 2.

The nature of the connections for operating the overdrive-engagement clutch 44 may be understood by added reference to FIG. 3, which shows three normally closed (NC), series-connected electric switches 64-65-66 for determining supply of local battery voltage to the solenoid 67, for closing a normally open hydraulic valve 68. Valve 68 is shown in FIG. 2 as being in a normal oil-distributing outlet line 70 from pump 60 and it governs discharge of lubricant via a discharge tube 69 into a series of passageconnected cavities serving the bearings 31–38. A relief valve 60′, forming part of a unitary assembly with pump 60, determines perferential flow in the outlet line 70 to valve 68; relief valve 60′ is thus operative to deliver flow in the shaft line 55 only when valve 68 is in its closed position. Switch 64 is labeled to indicate that it functions to open its NC contacts upon the boat operator's call for full throttle; switch 65 is labeled to indicate that its NC contacts may be deliberately opened by manual operation, as from a position on the operator's control and instrument panel; and switch 66 is labeled to indicate that it is pressure-operated in response to ram-pressure sampling of the water (due to forward motion of the boat), the adjustable means 66′ being set for example such that ram pressure opens the NC contacts at 66 upon achievement of a predetermined upper limit of the cruising-speed range. Thus, such operation of switch 66 (or, for that matter, of either of the other switches 64–65) is operative to de-energize solenoid 67, thereby re-establishing flow in the outlet line 70, with attendant direct drive via overrunning clutch 29; stated in other words, the overdrive remains operative only as long as all three switches 64-65-66 are in their normally closed condition.

Figure 3:
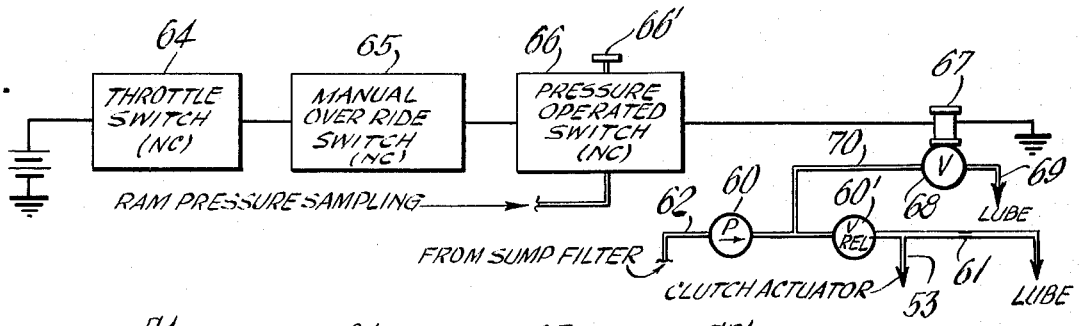
Figure 3A:
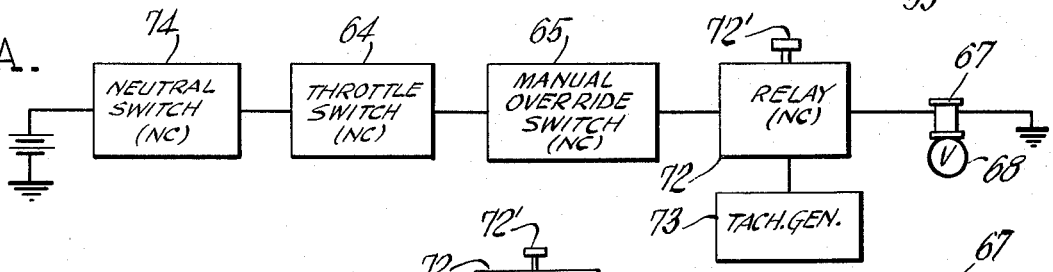
FIG. 3A is a diagram similar to FIG. 3, to illustrate a modification.

FIG. 3A is a schematic showing similar to that of FIG. 3, for an alternative arrangement wherein the relay 72 which is to be responsive to a predetermined cruise-speed limit is voltage-responsive, being set at 72′ to open its NC contacts when voltage generated by a tachometer generator 73 (e.g., tracking engine RPM) reaches a predetermined level corresponding to that for the desired cruise-speed limit. Other parts of FIG. 3A may be as described for FIG. 3, the same reference numbers being used, except that of course a further NC switch 74 may in series-connection with switches 65-65-66 so that a still further condition may determine drop-out operation of solenoid 67.

Figure 4:
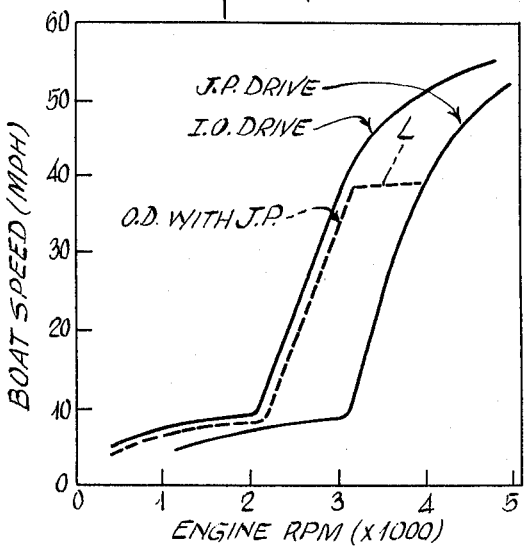
FIGS. 4 and 5 are graphs depicting performance of the engine and drive of FIG. 1, in comparison with conventional drives.

FIG. 4 graphically depicts performance (boat speed vs. engine speed) observed in comparative tests on a 21 -ft. Glastron boat, involving a 454 cu. in. Chevrolet engine. For the solid-line left-hand curve, labeled "I.O. Drive", a standard Mercruiser inboard/outboard drive was employed, using the 454 cu. in. engine. The curve displays an initial region of small slope before the boat achieves its planing condition; once the boat planes, there is a relatively straight steep slope of efficient cruising speeds, and for extreme upper speeds it is indicated by rounding of the curve that increments of boat speed are less for given increments of engine speed. The solid-line right-hand curve, labeled "J.P. Drive", represents performance of the water-jet drive, as a direct drive through all speed ranges; clearly, such a drive requires about 1000 rpm more than the I.O. drive to achieve a given cruising-range speed, while the extreme upper speeds are achieved with effectiveness approaching that of the I.O. drive. The dashed-line curve is labeled "O.D. with J.P." and indicates the performance improvement at boat speeds up to a predetermined upper limit (L) of cruising-range performance, obtained by using a 1:1.3 overdrive throughout the speed range up to limit L. Of course, when switch 66 (or 72) is operated, meaning detection of such upper limit, the jet-drive performance is transferred automatically to that depicted by the right-hand solid-line curve. For subsequent reduction in speed the ram-pressure switch 66 (or the tachometer-operated relay 72) will sense the limit L, thus completing the circuit to solenoid 67 and re-establishing the overdrive connection.

Figure 5:
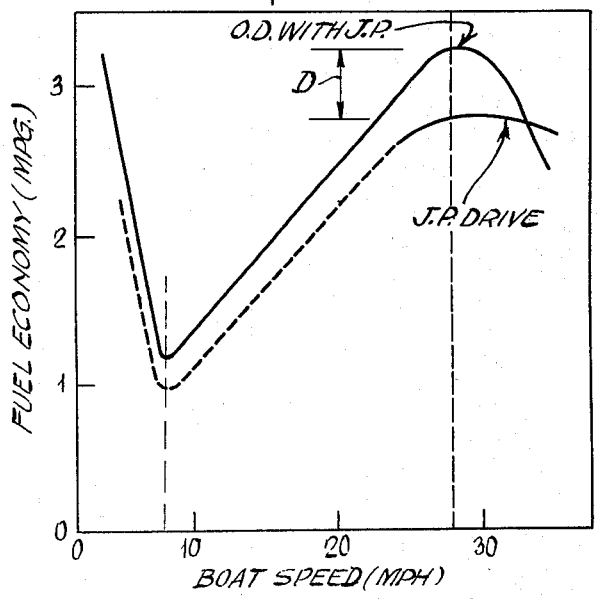

FIG. 5 comparatively depicts fuel economy observed as a function of boat speed, for the respective overdrive and direct-drive utilizations of precisely the same components in the same 21 -ft. boat. The fuel economy is seen to have peaked at close to 28 mph for this particular boat, but the use of overdrive is responsible for a 17 percent improvement in miles per gallon, denoted by legend D to indicate maximum difference between the two curves.

FIG. 6 shows a modification of FIG. 2 wherein the transmission 75 between engine 11 and the jet-drive means 12 includes provision for a "neutral" connection, i.e., disconnection to permit engine idling propulsion drive. The paths of automatic overdrive 76 and direct drive 77 will be recognized, but detail within the direct drive path 77 indicates provision for manual shift at 78 to separate engageable members 79, for the neutral condition, it being noted that the same provision is retained at 29 for one-way (clutch action). FIG. 6 further illustrates that placement of shift lever 78 in the neutral position actuates switch 67 (see also FIG. 3A) to open its normally closed contacts and thus assure against any overdrive coupling to the drive impeller 12, as long as "neutral" has been selected.

Figure 8:
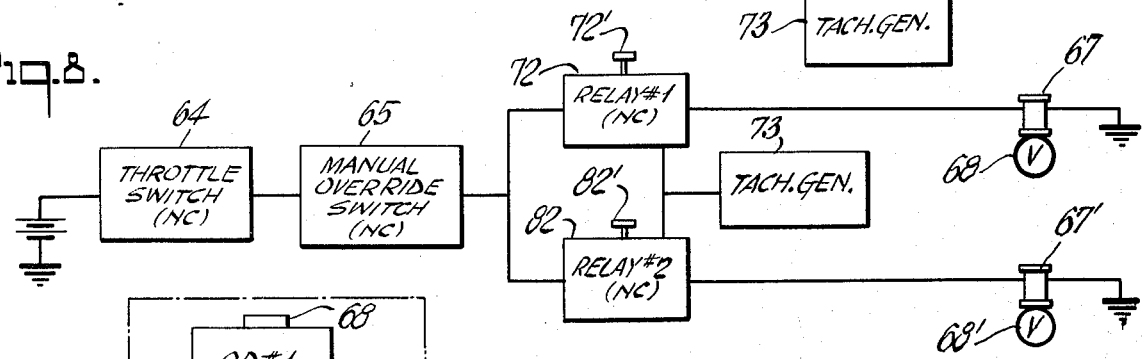
FIG. 8 is a circuit diagram for a control system for the modificaton of FIG. 7.
Figure 7:
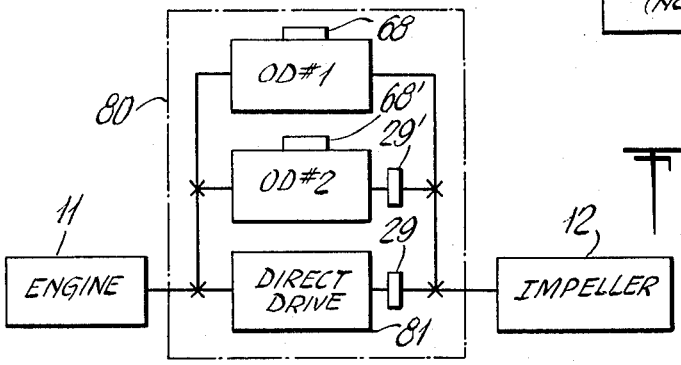
FIG. 7 is a diagram similar to FIG. 6 to illustrate another modification.

FIGS. 7 and 8 illustrate application of the invention to a multiple-speed overdrive transmission 80, connecting the output of engine 11 to the impeller 12. This transmission provides a first overdrive ratio "O.D. No. 1", for example, 1:1.3 for operation to a predetermined upper cruise speed, as described in connection with FIGS. 1 to 5; for a predetermined range of greater speeds, a second overdrive ratio "O.D. No. 2" is operative, for example at 1:1.2 , following declutching of the O.D. No. 1 connection. Finally, for speeds above a predetermined limit of O.D. No. 2 operation, the direct-drive connection 81 is established. The net result will thus be understood to introduce an intermediate step in the dashed-line function of FIG. 4, rendering the transition from overdrive to direct less abrupt than as depicted in FIG. 4.

To achieve the indicated two-speed overdrive, it will be understood that the overrunning clutch 29 again applies for the direct drive, and that a further overrunning clutch 29' is applicable to the lower-ratio O.D. No. 2 connection. Each of the two overdrives may include its own pump and control valve, such as the valve 68 already described for the higher-ratio coupling (O.D. No. 1 ), a similar valve 68' being indicated for O.D. No. 2 . The circuit of FIG. 8 will be recognized for the parallel arrangement of first and second NC relays 72–82 to determine the respective conditions under which valves 68–''' will be successively closed, to disconnect first one and then the other of the two overdrives. Thus, for context analogous to that previously discussed, relay 72 will have been adjusted at 72' to open its NC contacts when voltage generated by tachometer 73 is at the level corresponding to the speed for shift from O.D No. 1 to O.D. No. 2 . And relay 82 will have been adjusted at 82' to open its NC contacts when voltage generated by tachometer 73 is at a higher level, corresponding to the greater speed at which shift is desired for transfer O.D No. 2 to direct drive, as will be understood.

It will be seen that the described transmissions meet all stated objects with basically simple and reliable structure. The concept is applicable to a variety of ratios and speed-shifting conditions as is deemed appropriate for particular engine applications in particular boats. Regardless of the number of overdrive speeds selected, direct drive is always available when needed. The necessary result is longer life, less noise and fuel economy for an extended range of cruising speeds, with performance virtually matching the inboard/outboard, and with fewer operating limitations than for the I.O.; at the same time, recognized factors favoring the jet drive (over propeller drives) are retained.

While the invention has been shown and described in detail as to preferred embodiments, it will be understood that certain elements are to be deemed purely illustrative of principle. For example, in the case of FIG. 2, the lubricating system that has been described as to discharge at 69 into the transmission will be understood to illustrate but one of several such discharges, for the proper lubricating accommodation of all moving parts of the transmission. Also, for example, the overdrive connections may be of the planetary variety wherein shifting is accomplished by friction-band engagement of a selected part or parts of the planetary system, the control being then as appropriate for selected range utilization of detected ram pressure, tachometergenerator output, or such other index of speed as is desired or conveniently available.

What is claimed is:

1. A marine-jet drive transmission, comprising an input shaft for connection to an engine, an output shaft for connection to a jet impeller, first coupling means including a one-way engaging clutch for coupling said input shaft to said output shaft in the impeller-drive direction, selectively disengageable overdrive means coupling said shafts in bridging relation to said clutch, and speed-responsive means responsive to attainment of a predetermined upper limit of cruising speed and operative to disengage said overdrive means upon detection of said predetermined speed, whereby said impeller is geared for greater engine-speed ratios for boat speeds above said predetermined upper limit of cruising speed.

2. The transmission of claim 1, in which said last-defined means includes a probe of ram water pressure.

3. The transmission of claim 1, in which said last-defined means includes tachometer generator and a relay connected to said generator and operative to change its state upon attainment of a preselected generator-output voltage.

4. The transmission of claim 1, and including manually operative means connected for selective override of said speed-responsive means, whereby said overdrive means may be selectively disengaged.

5. The transmission of claim 1, and including throttle-operated means operable at substantially full-throttle condition and connected for selective override of said speed-responsive means, whereby said overdrive means may be disengaged substantially at the full-throttle condition.

6. The transmission of claim 1, and including a drive clutch in the direct-drive line of connection of said input and outputs shafts, said drive clutch including a movable actuating member having a drive position and a drive-disengaged neutral position, and overdrive control means responsive to the neutral position of said member and connected for override of said speed-responsive means only when said member is in the neutral position.

7. The transmission of claim 1, in which said first coupling means establishes a 1:1 direct-drive relation between input and output shaft rotation when said overdrive means is disconnected.

8. The transmission of claim 1, in which said first coupling means includes overdrive gear means having a lesser effective ratio than that of said selectively disengageable overdrive means.

9. A marine-jet drive transmission, comprising an input shaft for connection to an engine, an output shaft for connection to a jet impeller, first coupling means including a one-way engaging clutch for coupling said input shaft to said output shaft in the impeller-drive direction, selectively disengageable overdrive means coupling said shafts in bridging relation to said clutch, and speed-responsive means responsive to attainment of a predetermined upper limit of cruising speed and operative to disengage said overdrive means upon detection of said predetermined speed, said overdrive comprising a jackshaft offset from said input and output shafts, first meshing gears on said input and jack shafts, second meshing gears on said output and jack shafts, and disengageable clutch means coupling said first and second jackshaft gears for speeds less than said predetermined speed.

10. The transmission of claim 9, in which preloaded spring means biases said disengageable clutch means in the disengaging direction and in which power-operated means actuates said disengageable clutch, means to engaged condition for speeds less than said predetermined speed.

11. The transmission of claim 10, in which said disengageable clutch means is a disc clutch, hydraulic actuating means for said disc clutch, a lubricating pump for recirculating lubrication of said transmission, said pump having a first lubricating output line including a normally closed solenoid valve, and said pump having a second lubricating output line including a relief valve set to pass lubricant in said second output for output pressures in excess of those in said first line when said solenoid valve is open, whereby solenoid-valve closure diverts pump output to said second line, and an operative connection of said second line to said actuating means prior to lubricating discharge thereof into said transmission.

12. The transmission of claim 11 in which said second line includes an elongate passage within said jackshaft, said operative connection comprising a branch connection from said shaft passage to said actuating means, and a restrictive orifice in said second line between said branch connection and the location of first lubricating discharge into said transmission.

13. A marine-jet drive transmission, comprising an input shaft for connection to an engine, an output shaft for connection to a jet impeller, first coupling means including a one-way engaging clutch for coupling said input shaft to said output shaft in the impeller-drive direction, selectively disengageable overdrive means coupling said shafts in bridging relation to said clutch, and speed-responsive to attainment of a predetermined upper limit of cruising speed and operative to disengage said overdrive means upon detection of said predetermined speed, said selectively disengageable overdrive means being one of two selectively disengageable overdrives having different overdrive ratios, said speed-responsive means being responsive to attainment of a predetermined first upper limit of cruising speed to disengage the higher-ratio overdrive in favor of engagement of the lesser-ratio overdrive, and said speed-responsive means being further responsive to attainment of a predetermined second and higher upper limit of cruising speed to disengage the lesser-ratio overdrive in favor of said first coupling means.

14. The transmission of claim 13, in which said lesser-ratio overdrive means includes a one-way engaging clutch whereby, when operative, said higher-ratio overdrive may override said lesser-ratio overdrive.

15. A marine-jet drive transmission, comprising an input shaft for connection to an engine, an output shaft for connection to a jet impeller, first coupling means including a one-way engaging clutch for coupling said input shaft to said output shaft in the impeller-drive direction, selectively disengageable overdrive means coupling said coupling said shafts in bridging relation to said clutch, and speed-responsive means responsive to attainment of a predetermined upper limit of cruising speed and operative to disengage said overdrive means upon detection of said predetermined speed in an accelerating change of speed, said speed-responsive means being also operative to re-engage said overdrive means upon detection of substantially said predetermined speed in a decelerating change of speed; whereby said impeller is geared for greater engine-speed ratios for boat speeds above cruising speed and is geared for lesser engine-speed ratios for the lower speeds which include cruising.

16. A marine-jet drive transmission, comprising an input shaft for connection to an engine, an output shaft for connection to a jet impeller, direct-drive coupling means including a one-way engaging clutch for direct 1:1 coupling of said input shaft to said output shaft in the impeller-drive direction, selectively disengageable overdrive means coupling said shafts in bridging relation to said clutch, and means operative to disengage said overdrive means and to operatively engage said direct-drive means upon detection of a predetermined speed in an accelerating change of speed, said last-defined means being also operative to re-engage said overdrive means and to overrun said direct-drive means upon detection of substantially said predetermined speed in a decelerating change of speed; whereby said impeller is geared for greater engine-speed ratios for boat speeds above said predetermined speed and is geared for lesser engine-speed ratios for speeds below said predetermined speed.

17. The method of operating a boat equipped with a marine-jet drive transmission having plural selectively engageable couplings including a direct-drive coupling and an overdrive coupling between an engine and a jet impeller, which method comprises operatively engaging the overdrive coupling in overrunning relation to the direct-drive coupling for speeds less than a predetermined upper limit of cruising speed, disengaging the overdrive coupling and engaging the direct-drive coupling upon detection of substantially said predetermined speed in the course of an accelerating change of speed, and re-establishing the overdrive coupling in overrunning relation to the direct-drive coupling upon detection of substantially said predetermined said predetermined speed in the course of a decelerating change of speed; whereby the impeller is geared for greater engine-speed ratios for boat speeds above cruising and is geared for lesser engine-speed ratios for the lower speeds which include cruising.

18. A variable speed marine-jet drive assembly for use on a boat including an engine, a marine jet impeller and housing and change-speed gearing arranged between and for engaging said engine to said jet impeller, said change-speed gearing providing an automatic power gear change from a higher forward drive ratio to a lower forward drive ratio with increase in boat speed, the higher of said drive ratios being for engagement at all low and cruising speeds, and the lower of said drive ratios being for high speeds alone.

19. A variable speed marine-jet drive assembly according to claim 18, in which said engine includes throttle-operated means operable at substantially full-throttle condition, whereby said power gear change from higher forward drive ratio to lower forward drive ratio is automatically effected upon a throttle shift to substantially full-throttle condition.

20. A variable speed marine jet drive assembly according to claim 18, in which said change-speed gearing includes means responsive of attainment of a predetermined engine speed for automatically effecting said power gear change from higher forward drive ratio to lower forward drive ratio.

21. A variable speed marine-jet drive assembly according to claim 18, in which said change-speed gearing includes means responsive to attainment of a predetermined boat speed for automatically effecting said power gear change from higher forward drive ratio to lower forward drive ratio.

* * * * *